US007956305B2

(12) United States Patent
Fietz et al.

(10) Patent No.: US 7,956,305 B2
(45) Date of Patent: Jun. 7, 2011

(54) HOUSING WITH A SLIDING SWITCH

(75) Inventors: Ralf-Peter Fietz, Paderborn (DE); Rienhard Salmen, Lichtenau (DE)

(73) Assignee: Fujitsu Siemens Computers GmbH, Munich (DE)

( * ) Notice: Subject to any disclaimer, the term of this patent is extended or adjusted under 35 U.S.C. 154(b) by 189 days.

(21) Appl. No.: 12/370,186

(22) Filed: Feb. 12, 2009

(65) Prior Publication Data

US 2009/0218202 A1 Sep. 3, 2009

(30) Foreign Application Priority Data

Feb. 28, 2008 (DE) ..... 10 2008 011 707

(51) Int. Cl.
*H01H 3/40* (2006.01)

(52) U.S. Cl. ..... 200/550; 200/318.2; 200/519; 200/547

(58) Field of Classification Search ..... 200/43.01, 200/537, 547, 548, 16 R, 519, 550, 318.2
See application file for complete search history.

(56) References Cited

U.S. PATENT DOCUMENTS

| | | | | |
|---|---|---|---|---|
| 4,006,334 | A * | 2/1977 | Robotham et al. | 200/43.17 |
| 4,376,234 | A * | 3/1983 | Liataud et al. | 200/16 R |
| 6,313,420 | B1 | 11/2001 | Ohashi | 200/302.1 |
| 6,333,479 | B1 | 12/2001 | Tai | 200/550 |
| 2001/0032777 | A1 | 10/2001 | Finch et al. | 200/16 |

FOREIGN PATENT DOCUMENTS

| | | |
|---|---|---|
| DE | 37 04 811 | 2/1987 |
| DE | 39 30 002 | 9/1989 |

* cited by examiner

*Primary Examiner* — Edwin A. Leon
*Assistant Examiner* — Vanessa Girardi
(74) *Attorney, Agent, or Firm* — Hayes Soloway P.C.

(57) ABSTRACT

A housing with a sliding switch with at least three positions and a sliding element that partially projects through an opening in the housing as provided. In order to protect the sliding element against accidental activation, on both sides of the opening, parallel to the direction of movement of the sliding switch, there are flanks.

8 Claims, 3 Drawing Sheets

HOUSING WITH A SLIDING SWITCH

BACKGROUND OF THE INVENTION

The invention relates to a housing with a sliding switch with at least three positions, wherein the housing has an opening through which a sliding element of the sliding switch projects at least partially.

Such housings with sliding switches are often installed on the front side in memory sub-systems. These sliding switches usually have three positions, that is, the O position (OFF) in which the system is completed turned off, the I position (ON) in which the system is turned on and in local operation, and the R position (REMOTE) in which the system is also operating, but can be controlled by means of a LAN. Normally, the O position is at the first position of the sliding switch, i.e., it is not in the middle.

Because sliding switches of this type are installed on the front side, the risk of unintentional shifting of the sliding element is relatively high. In addition, the consequences of unintentional shifting of the sliding element can be very serious, for example, if the memory sub-system is completely turned off without the data having been previously stored.

A second problem consists in that when switching from the I position (ON) into the R position (REMOTE) or vice versa, switching can overshoot the target, and the system is then unintentionally completely turned off.

In order to prevent unintentional shifting of the sliding element and accidental turning off of the system, a protective device is needed.

Until now, solutions have been known in which the protective device is constructed as an additional switch. Here, in normal use, the sliding switch effectively has two stages, and a third position can be reached only after pressing a safety button. This solution is often used for video cameras, Disadvantages in this type of solution include the associated complication and costs in production. The additional switch usually requires additional electronics.

SUMMARY OF THE INVENTION

Therefore, the invention is based on the task of disclosing a housing with a sliding switch with at least three positions, wherein this housing allows easier and more cost effective protection against accidental activation than was previously typical.

This task is achieved according to the invention in that, on both sides of the opening, in parallel to the direction of movement of the sliding switch, flanks are provided that are used for lateral protection of the sliding switch against accidental activation.

The flanks are preferably constructed at least so high that the sliding element does not project past the flanks. Thus, the sliding element is protected from above and below against accidental shifting if a person or an object inadvertently contacts the sliding switch.

Additional protection against unintentional shifting of the sliding element into an undesired position can be integrated into the housing. According to this preferred embodiment of the invention, one of the flanks has a catch mechanism that limits the switching between two adjacent positions. The catch mechanism has a movable construction, so that it can be released again, and the sliding element can be pushed into a directly adjacent third position. Preferably, the flank with a catch mechanism has a spring-like construction.

According to a third embodiment of the invention, the two flanks are connected by a bridge that allows, but hides, a position of the sliding switch underneath the bridge. The bridge prevents shifting of the sliding element past the position underneath the bridge because the bridge lies transverse to the sliding direction. In a three-stage sliding switch, the bridge preferably hides the middle position of the sliding switch.

All three embodiments of the invention can be produced economically and with little complication because the protective device can be injection molded directly on the housing, which is associated with little extra costs for the injection-molding die, or can be injection molded together with the housing, which makes a one-time new injection mold necessary for the housing. Afterwards, changes neither to the switch nor the circuit board are required.

BRIEF DESCRIPTION OF THE DRAWINGS

Other advantageous configurations are disclosed in the subordinate claims and also in the following description of the figures. The invention will now be explained in greater detail with reference to three embodiments shown in the drawings.

Shown in the drawings are.

DETAILED DESCRIPTION OF THE DRAWINGS

Figure 1A:
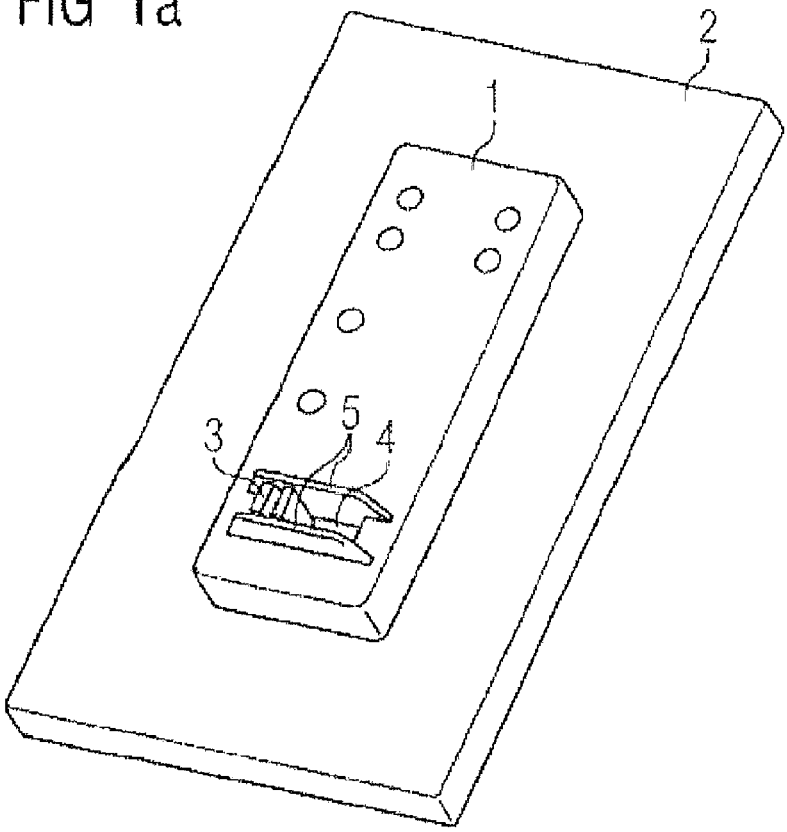
FIGS. 1*a* and 1*b*, each a perspective, three-dimensional view of a housing with sliding switch and two flanks, FIG. 2, a perspective, three-dimensional view of a cut-out of a housing with a sliding switch, two flanks, and a bridge connecting the flanks, and FIG. 3, a perspective, three-dimensional view of a cut-out of a housing with a sliding switch and two flanks in which one flank has a spring-like construction.

FIG. 1*a* shows a sliding switch with a housing 1 for the sliding switch, wherein this housing is installed on the front side in a part of a memory sub-system housing 2.

Figure 1B:
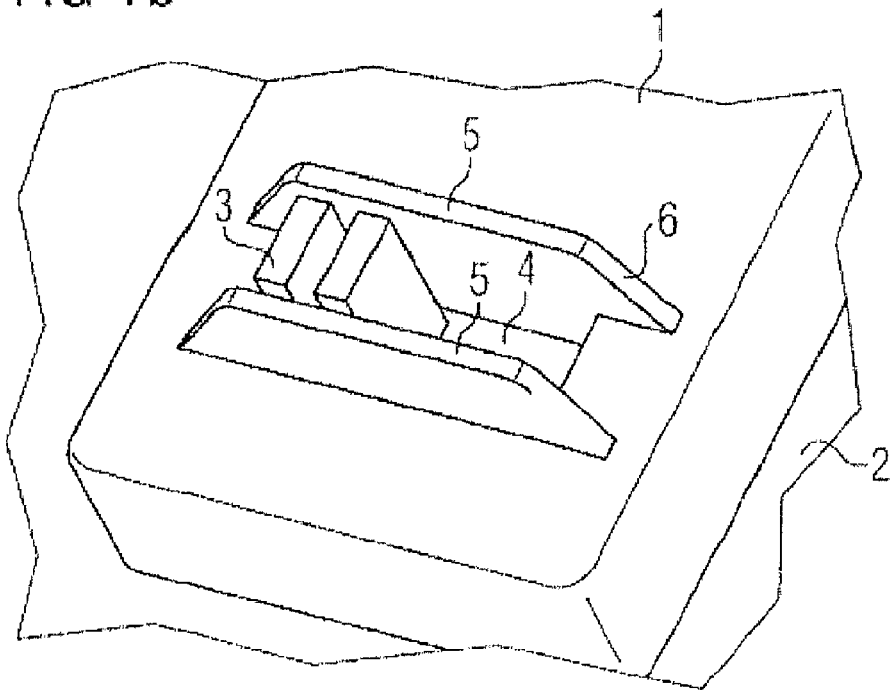

FIG. 1*b* shows an enlarged cut-out of the sliding switch housing 1. The sliding switch has a sliding element 3 that partially projects through an opening 4 in the housing 1. The sliding switch has three positions that lie linearly one next to the other. In parallel to the direction of motion of the sliding element 3, the housing 1 has a flank 5 on both sides of the opening 4. The flanks 5 are constructed at least high enough that the sliding element 3 does not project past the flanks 5. Thus, the flanks 5 protect the sliding element 3 against accidental activation from above or from below. In order to bother the user less, the ends of the flanks 5 are rounded or beveled. In these cases, the flanks 5 are constructed longer than the opening 4, so that the sliding element 3 is still protected by nearly the entire height of the flanks 5 on both outer positions. That is, the rounding or bevel 6 begins approximately at the part of the flank 5 that projects past the opening 4.

Figure 2:
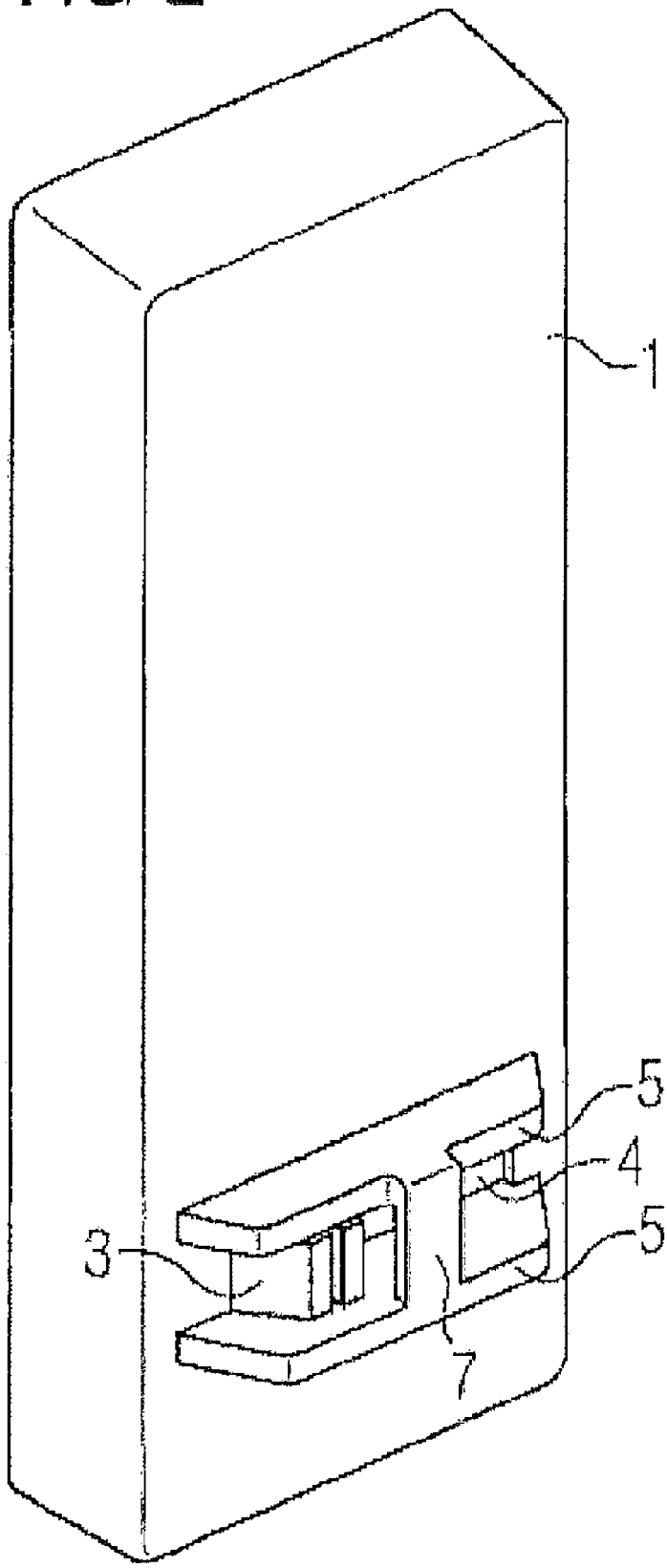

FIG. 2 shows a sliding switch with a housing 1 like in FIGS. 1*a* and 1*b*, but also with a protective bridge 7 that connects the two flanks 5. The bridge 7 is constructed so that the sliding element 3 can be pushed under the bridge 7 and then can be pushed farther under the bridge laterally, for example, with a pen or another tool that fits under bridge 7. The bridge 7 thus hides one position of the sliding switch.

In FIG. 2, the middle position of the sliding switch is covered with the bridge 7. This position is preferred, because the O position is normally arranged as the first position or third position and a bridge 7 over the middle position protects from accidental switching to the first and third positions. In this example, the first position is the O position (OFF), the second position is the R position (REMOTE), and the third position is the I position (ON). With one finger, the switch can be pushed from OFF to REMOTE. To switch farther from REMOTE to ON, the sliding element 3 must be further shifted with the help of a tool (for example, a pen) underneath the bridge 7. But more important is that the sliding element 3 can be easily shifted with a finger from the I position (ON) to the middle R position (REMOTE), without accidentally reaching the O position (OFF), because the bridge 7 prevents this.

Figure 3:
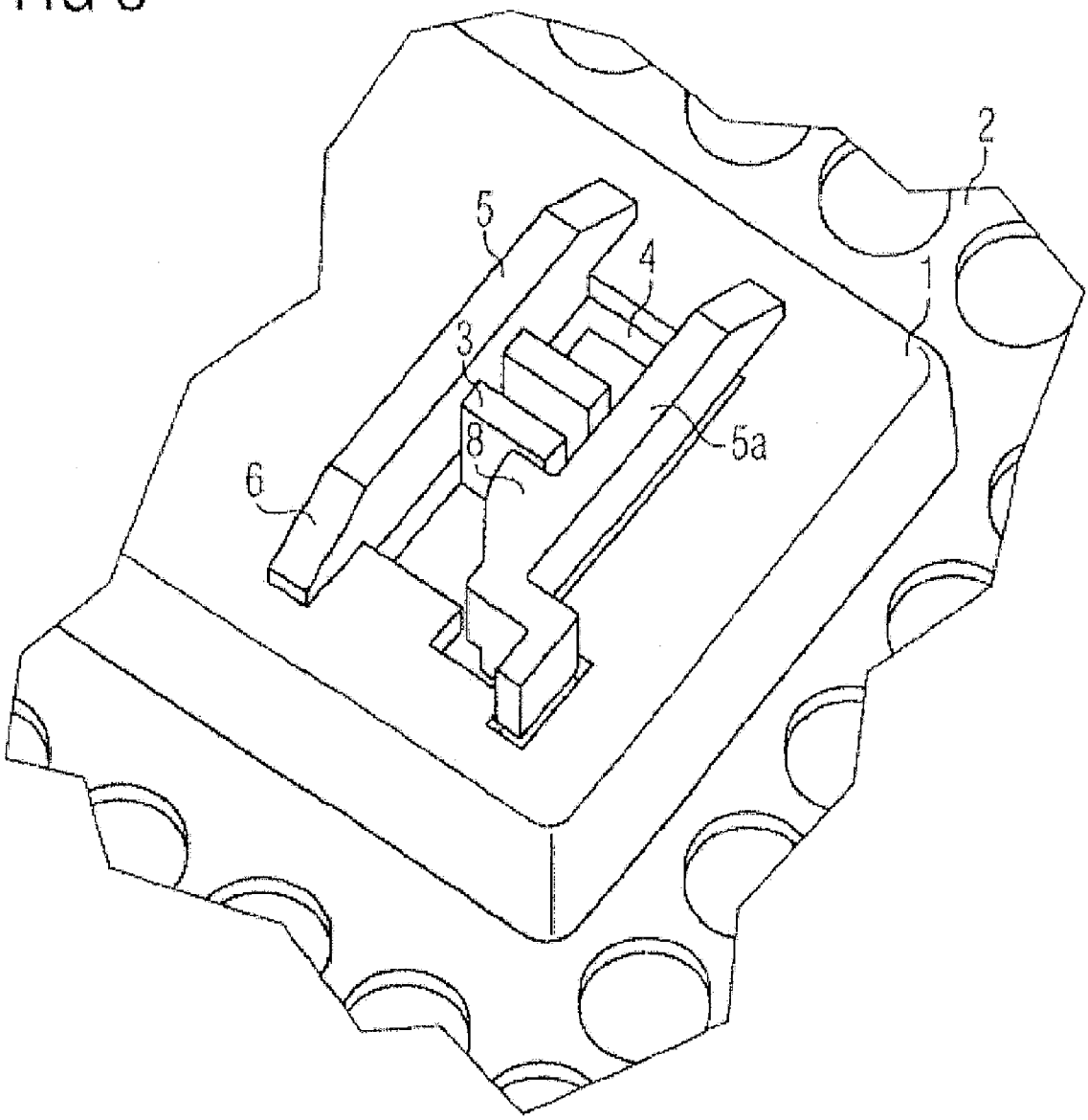

FIG. 3 shows a third embodiment of the invention in which a flank 5*a* has a spring-like construction and has a wedge-shaped catch mechanism 8. When the sliding element 3 is in the first position, the spring-like flank 5*a* is in a tensioned state. The wedge-shaped catch mechanism 8 allows the sliding element 3 to be easily shifted from the first position into the middle position without additional measures. It can also be shifted back and forth as usual between the middle position and the third position. In order to shift the sliding element 3 back into the first position, namely the O position, first the spring-like flank 5*a* must be pressed perpendicular to the direction of movement of the sliding element 3, so that the sliding element 3 is freed from the catch mechanism 8 and can then be pushed farther into the first position. The spring-like flank 5*a* can then be released and contacts the sliding element 3 in tensioned state.

We claim:

1. A housing with a sliding switch with at least three positions, wherein the housing has an opening through which a sliding element of the sliding switch at least partially projects, wherein, on both sides of the opening, parallel to the direction of movement of the sliding element, there are flanks that are provided for lateral protection of the sliding element against accidental activation, and wherein one of the flanks has a catch mechanism that restricts the switching between two adjacent positions, so that accidental switching to a directly adjacent third position can be prevented, and the flank has a movable construction, so that the catch mechanism can be released again, so that the third position can be switched.

2. The housing according to claim 1, wherein the catch mechanism has a wedge-shaped construction.

3. The housing according to claim 1, wherein the flanks are constructed so that the sliding element does not project past the flanks.

4. The housing according to claim 3, wherein the flank having a catch mechanism has a spring-like construction.

5. The housing according to claim 3, wherein the catch mechanism has a wedge-shaped construction.

6. The housing according to claim 1, wherein the flank having a catch mechanism has a spring-like construction.

7. The housing according to claim 6, wherein the catch mechanism has a wedge-shaped construction.

8. A housing with a sliding switch with at least three positions, wherein the housing has an opening through which a sliding element of the sliding switch at least partially projects, wherein, on both sides of the opening, parallel to a direction of movement of the sliding element, there are flanks that are provided for lateral protection of the sliding element against accidental activation, wherein the flanks are constructed so that the sliding element does not project past the flanks, and wherein the two flanks are connected by a bridge that is constructed so that the sliding element can be pushed under the bridge such that the bridge allows, but covers, a position of the sliding element underneath the bridge.

* * * * *

UNITED STATES PATENT AND TRADEMARK OFFICE

CERTIFICATE OF CORRECTION

PATENT NO. : 7,956,305 B2
APPLICATION NO. : 12/370186
DATED : June 7, 2011
INVENTOR(S) : Fietz et al.

It is certified that error appears in the above-identified patent and that said Letters Patent is hereby corrected as shown below:

Title Page, item 75
Inventor Rienhard Salmen should be --Reinhard Salmen--.

Signed and Sealed this
Third Day of January, 2012

David J. Kappos

David J. Kappos
*Director of the United States Patent and Trademark Office*